US005332373A

United States Patent [19]

Schendel

[11] Patent Number: 5,332,373

[45] Date of Patent: Jul. 26, 1994

[54] VERTICAL PUMP AND METHOD FOR ACCESSING SAME

[75] Inventor: Dennis M. Schendel, Orangevale, Calif.

[73] Assignee: Baker Hughes Incorporated, Houston, Tex.

[21] Appl. No.: 99,957

[22] Filed: Jul. 30, 1993

[51] Int. Cl.[5] ..... F04B 17/00

[52] U.S. Cl. ..... 417/360; 417/424.1

[58] Field of Search ..... 417/360, 361, 424.1, 417/319; 222/333

[56] References Cited

U.S. PATENT DOCUMENTS

| | | | |
|---|---|---|---|
| 1,082,183 | 12/1913 | Vernon | 417/360 |
| 2,047,330 | 7/1936 | Petersen | 417/360 |
| 2,474,611 | 6/1949 | Wylie | 417/360 |
| 2,947,260 | 8/1960 | Hornschuch | 417/360 |
| 3,324,798 | 6/1967 | Freed et al. | 417/360 |
| 3,743,447 | 7/1973 | Lynch | 417/360 |
| 3,880,553 | 4/1975 | Wolford et al. | 417/360 |
| 4,152,125 | 5/1979 | Pettye | 417/361 |
| 4,224,363 | 9/1980 | Veronesi et al. | 417/361 |
| 4,403,923 | 9/1983 | Korchin | 417/360 |
| 4,900,438 | 2/1990 | McEwen | 417/360 |
| 5,154,584 | 10/1992 | McEwen | 417/360 |
| 5,185,941 | 2/1993 | Dongelmans | 417/360 |

FOREIGN PATENT DOCUMENTS

| | | | |
|---|---|---|---|
| 2041984 | 3/1971 | Fed. Rep. of Germany . | |
| 2059353 | 6/1971 | Fed. Rep. of Germany . | |
| 0407268 | 3/1934 | United Kingdom | 417/360 |
| 2242932 | 10/1991 | United Kingdom | 417/360 |

*Primary Examiner*—Richard A. Bertsch
*Assistant Examiner*—Michael I. Kocharov
*Attorney, Agent, or Firm*—R. Neil Sudol; Henry D. Coleman; Michael Polacek

[57] ABSTRACT

A pump comprises a pump superstructure, a housing having a longitudinal axis, and mounting elements for pivotably mounting the housing on the superstructure for enabling a swinging of the housing between a vertical operational orientation and a horizontal maintenance orientation. The longitudinal axis of the housing is substantially vertical in the operational orientation of the housing and substantially horizontal in the maintenance orientation. An impeller is rotatably disposed in the housing for rotation about the longitudinal axis in the operational orientation of the housing, while a drive is fixed to the superstructure in a stationary location for rotatably driving the impeller. A coupling component is provided on the superstructure for enabling a connection of the drive to the impeller upon a pivoting of the housing from the maintenance orientation to the operational orientation and for alternately enabling a disconnection of the drive from the impeller prior to a pivoting of the housing from the operational orientation to the maintenance orientation.

15 Claims, 2 Drawing Sheets

VERTICAL PUMP AND METHOD FOR ACCESSING SAME

BACKGROUND OF THE INVENTION

This invention relates to a vertically oriented centrifugal pump, and more specifically, although not exclusively, to a vertically oriented pitot pump. This invention also relates to a method for accessing such a vertical pump, for example, for repair or maintenance operations.

Pitot pumps are centrifugal pumps which have an impeller or rotor rotatably driven inside a housing. A pitot tube is disposed inside the impeller for capturing and redirecting rotating fluid from the impeller to an outlet. To that end, the pitot tube has a circumferential input stub located near the periphery of the impeller cavity, a radially extending central portion and an axially extending output stub connected to the pump outlet.

Pitot pumps are known, for example, from U.S. Pat. Nos. 3,384,024 to King and 3,999,881 to Crichlow.

Pitot pumps are generally used in a horizontal orientation in commercial applications. The pump impeller rotates about a horizontal axis. Such pitot pumps are advantageous in that pump maintenance, such as the replacement of seals, can be performed expeditiously particularly in comparison to other types of pumps. Maintenance can be undertaken without removing the impeller and without disconnecting the bearings.

Many non-pitot type pumps are disposed in a vertical orientation to preserve floor or ground space, which is at a premium. In a vertical pump configuration, the drive motor is located in vertical alignment with the rotor.

The disposition of a pitot type pump in a vertical orientation is not generally feasible owing to a substantial increase in the difficulty of changing the seals. The problem arises, therefore, to enable or facilitate pump maintenance where a pitot pump is placed in a vertical configuration.

SUMMARY OF THE INVENTION

A pump comprises, in accordance with the present invention, a pump superstructure, a housing having a longitudinal axis, and mounting elements for pivotably mounting the housing on the superstructure for enabling a swinging of the housing between a substantially vertical operational orientation and a maintenance orientation at an angle, preferably approximately 90°, with respect to the vertical. The longitudinal axis of the housing is substantially vertical in the operational orientation of the housing and at an angle to the vertical in the maintenance orientation. An impeller is rotatably disposed in the housing for rotation about the longitudinal axis in the operational orientation of the housing, while a drive is fixed to the superstructure in a stationary location for rotatably driving the impeller. A coupling component is provided on the superstructure for enabling a connection of the drive to the impeller upon a pivoting of the housing from the maintenance orientation to the operational orientation and for alternately enabling a disconnection of the drive from the impeller prior to a pivoting of the housing from the operational orientation to the maintenance orientation.

According to another feature of the present invention, the mounting elements include a pair of pivot bearings attached to the superstructure on opposite sides of the housing. Preferably, the pivot bearings are aligned with one another to define a substantially horizontal pivot axis of the housing relative to the superstructure. The pivot axis is preferably located slightly below the center of gravity of the pump housing and its contents. Thus, the housing naturally remains in the maintenance orientation upon being placed in that position.

In a pitot type pump, the impeller defines a hollow chamber or cavity, while the pump further comprises a pitot tube disposed in the impeller, the pitot tube having a pump outlet disposed below the impeller in the operational orientation of the housing.

According to a further feature of the present invention, the mounting elements include a removable tie plate and a disconnectable hollow coupling disposed between the drive and the housing. In addition, detachable locking plates may connect the housing to the superstructure, for example, below the pivot axis of the housing.

The present invention is also directed to a method for accessing a pump having a housing mounted to a support superstructure and also having an impeller rotatably disposed in the housing. The pump includes a drive mounted to the superstructure and operatively connected to the impeller. The pump further includes an inlet port and an outlet port connected to an inlet conduit and an outlet conduit, respectively. The method comprises the steps of (a) disconnecting the impeller and the housing from the drive, (b) disconnecting the inlet port from the inlet conduit and the outlet port from the outlet conduit, (c) upon completion of the steps of disconnecting, pivoting the housing together with the impeller about a substantially horizontal axis to swing the housing from a substantially vertical operational orientation to an angled maintenance orientation, (d) maintaining the drive in a fixed location on the superstructure before, during and after the step of pivoting, (e) performing maintenance operations on components of the pump while the housing is maintained in the maintenance orientation, (f) upon completion of the step of performing, rotating the housing together with the impeller about the horizontal axis to swing the housing from the maintenance orientation to the operational orientation, and (g) upon completion of the step of rotating, reconnecting the impeller and the housing to the drive and reconnecting the inlet port to the inlet conduit and the outlet port to the outlet conduit.

Preferably, the maintenance orientation of the housing is substantially horizontal. However, all that is necessary is enough of an angle with respect to the vertical to enable maintenance personnel to access the housing. The maintenance task performed may range anywhere from simple inspection to replacement of key structures.

Pursuant to another feature of the present invention, where the pump includes a tie plate disposed between a drive coupling and the housing, the disconnection of the impeller and the housing from the drive includes the step of removing the tie plate.

Where the pump includes locking plates connecting the housing to the superstructure, the method further comprises the step of removing the locking plates prior to the step of pivoting the housing and the impeller from the operational orientation to the maintenance orientation.

Pursuant to an additional feature of the present invention, the maintenance or repair operation includes the steps of removing a seal from the housing and inserting a substitute seal. The seal is located between the impeller and a manifold at the end of the housing opposite the drive in the operational orientation of the assembly.

Pursuant to another feature of the present invention, the method further comprises the step of supporting the housing at least partially from the superstructure during the steps of pivoting, performing and rotating.

A pump provided with a tip-out capability in accordance with the present invention is especially useful in facilitating repair operations on vertically configured pumps, particularly vertically configured pitot type pumps. Vertically configured pitot pumps are not realistically feasible without repair operations being facilitated by a pivoting housing and impeller structure in accordance with the present invention.

DETAILED DESCRIPTION

Figure 1:
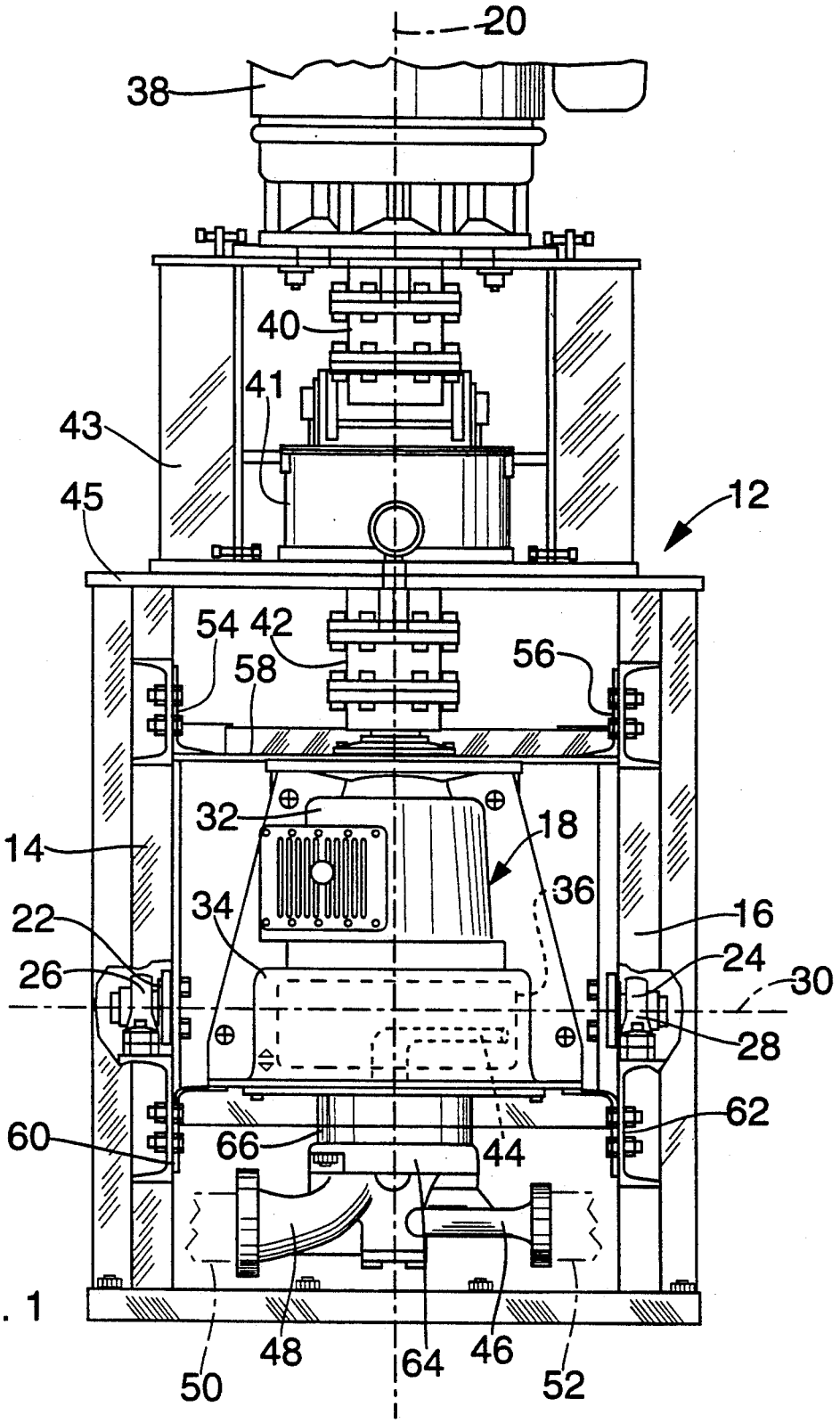
FIG. 1 is a side elevational view of a vertically configured pitot type pump in accordance with the present invention.

As shown in the drawing, a vertically configured pitot type pump comprises a superstructure or frame 12 including a plurality of upright members 14 and 16. A housing 18 having a longitudinal axis 20 is pivotably mounted to frame 12 via a pair of pivot shafts 22 and 24 rotatably attached to respective bearings 26 and 28 in turn fastened to upright members 14 and 16. Pivot shafts 22 and 24 and bearings 26 and 28 are horizontally aligned with one another to define a substantially horizontal pivot axis 30 about which housing 18 is tiltable between the vertical operational orientation illustrated in FIG. 1 and a horizontal maintenance orientation illustrated in FIG. 2. Longitudinal axis 20 of housing 18 is substantially vertical in the operational orientation of housing 18 and substantially horizontal in the maintenance orientation. Pivot axis 30 is preferably located slightly below a center of gravity of pump housing 18 and its contents.

Housing 18 includes a first portion 32 which encases bearing componentry (not shown) and a second portion 34 which surrounds an impeller 36. Impeller 36 is rotatably disposed in housing 18 for rotation about longitudinal axis 20 in the vertical operational orientation of housing 18. In the operational orientation of housing 18, impeller 36 is operatively connected to a drive motor 38 which is fixed to frame 12 in a stationary location vertically above housing 18. One or more spacer couplings 40 and 42 connected to frame 12 are disposed between motor 38 and impeller housing 18 for enabling a connection of the motor to the impeller upon a pivoting of housing 18 from the horizontal, maintenance orientation to the vertical, operational orientation and for alternately enabling a disconnection of motor 38 from impeller 36 prior to a pivoting of housing 18 from the operational orientation to the maintenance orientation.

Figure 2:
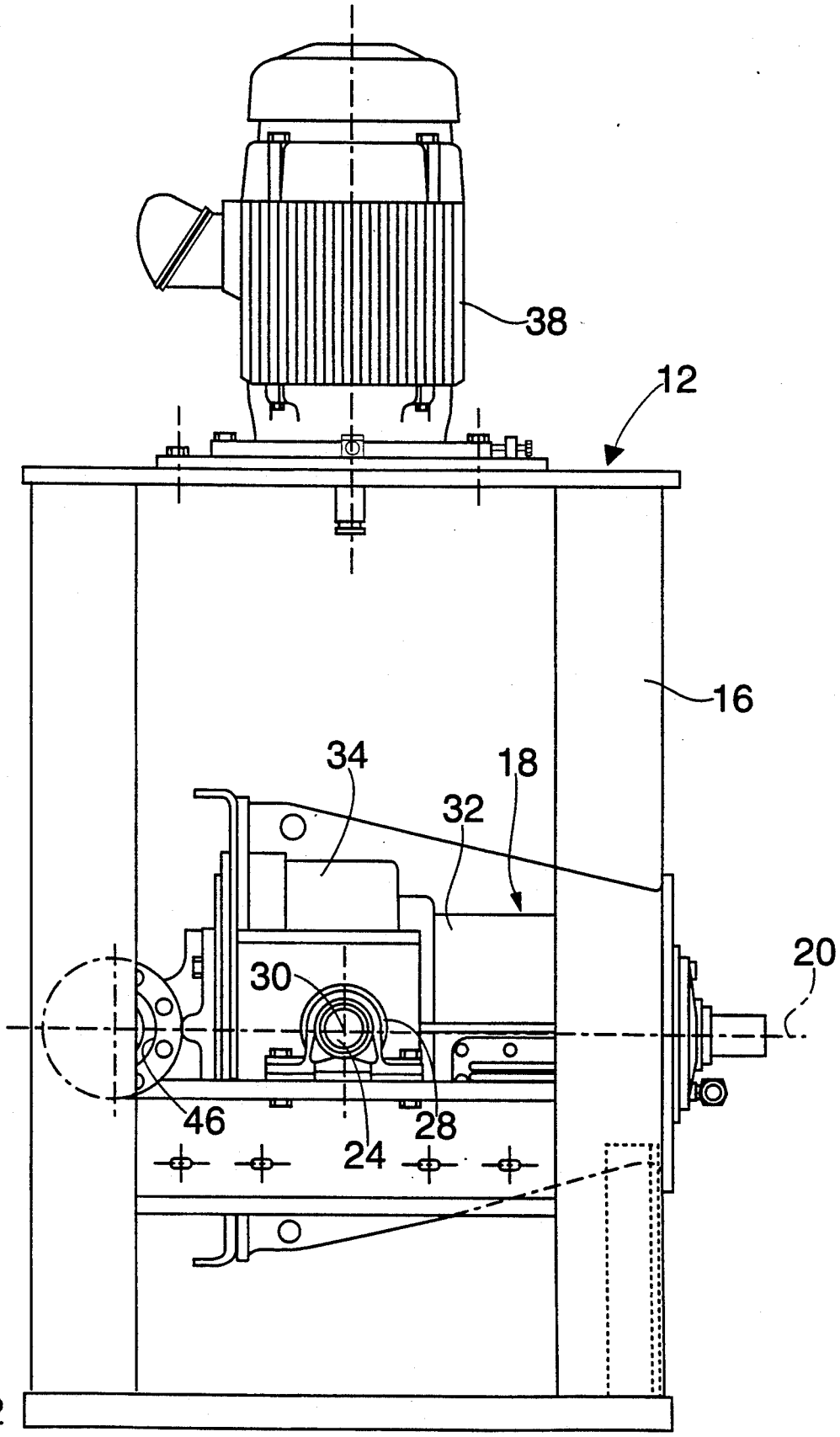
FIG. 2 is a front elevational view of a modified pitot type pump, similar to that illustrated in FIG. 1, showing a horizontal maintainance orientation of a pump housing shown in FIG. 1.

Coupling 40 is associated with an optional gear box 41. Gear box 41 and coupling 40 are fastened to a frame subassembly 43 connected to frame 12. In some applications, gear box 41 and coupling 40, together with frame subassembly 43, are omitted as shown in FIG. 2. In that event, motor 38 is mounted directly to a horizontal plate 45 at the top of frame 12. Where gear box 41 and coupling 40 are used, as in the drawing, they are parts of a drive assembly including motor 38 and accordingly remain fixed to frame 12 regardless of the orientation of housing 18.

A pitot tube 44 is disposed inside impeller 36, the pitot tube having a pump outlet port 46 disposed below the impeller in the operational orientation of housing 18. A pump inlet port 48 connected to housing 18 is also disposed below impeller 36 in the operational orientation of housing 18. During operation of the pump, inlet port 48 and outlet port 46 are respectively connected to an inlet conduit 50 and an outlet conduit 52.

To repair or inspect the pump, impeller 36 and housing 18 are disconnected from motor 38 by first loosening coupling 42 and then detaching upper locking plates 54 and 56 to remove a tie plate 58. In the operational configuration of the pump, locking plates serve to secure tie plate 58 and accordingly the upper end of housing 18 to frame 12. In FIG. 2, upper locking plates 54 and 56, tie plate 58, and spacer coupling 42 are omitted.

Lower locking plates 60 and 62 which secure the lower end of housing 18 to frame 12 are also uncoupled. In addition, inlet port 48 and outlet port 46 are disconnected from inlet conduit 50 and outlet conduit 52, respectively. At that juncture, housing 18 together with impeller 36 is pivoted about axis 30 to swing the housing from the vertical operational orientation of FIG. 1 to the horizontal maintenance orientation of FIG. 2. It is to be noted that during this procedure, motor 38 remains fixed on the superstructure. Subsequently, maintenance (inspection, repair) operations are performed on components of the pump internal to housing 18, while the housing is maintained in the horizontal maintenance orientation. More specifically, a manifold area 64 in the lowermost portion of housing 18 contains sealing componentry which may be replaced during the maintenance operations. The seal (not shown) may be located between manifold 64 and an optional spacer 66.

Upon completion of the maintenance operations, housing 18 together with impeller 36 is rotated about axis 30 to swing the housing from the horizontal maintenance orientation to the vertical operational orientation. Upon completion of the rotation, impeller 36 and housing 18 are reconnected to motor 38 essentially by reversing the disconnection steps. Inlet port 48 and outlet port 48 are reconnected to inlet conduit 50 and outlet conduit 52.

During the maintenance operation, housing 18 is supported at least in part from frame 12. Maintenance is simplified and facilitated by the tipping out of the pump housing 18 to enable ready access to the internal components of the housing.

It is to be noted that maintenance operations performed on a pump as described herein may include simple inspections, as well as repair and replacement of parts. The maintenance orientation of pump housing 18 is preferably horizontal, but may alternatively be at an acute angle with respect to the vertical, provided that there is sufficient space in the angled maintenance orientation to permit access of maintenance personnel to the pump.

Although the invention has been described in terms of particular embodiments and applications, one of ordinary skill in the art, in light of this teaching, can generate additional embodiments and modifications without departing from the spirit of or exceeding the scope of the claimed invention. For example, the principles of the instant invention, although developed primarily for application to pitot pumps, can be usefully applied to other types of vertical pumps. In addition, impeller 36 may be rotated by a drive other than motor 38, such as a turbine. Accordingly, it is to be understood that the drawings and descriptions herein are profferred by way of example to facilitate comprehension of the invention and should not be construed to limit the scope thereof.

What is claimed is:

1. A pump comprising:

a pump superstructure;

a housing having a longitudinal axis;

mounting means for pivotably mounting said housing on said superstructure for enabling a swinging of said housing and said impeller between said operational orientation and a maintenance orientation, said longitudinal axis being substantially vertical in said operational orientation of said housing and at an angle to the vertical in said maintenance orientation;

an impeller rotatably disposed in said housing for rotation about said longitudinal axis in an operational orientation of said housing;

drive means fixed to said superstructure in a stationary location for rotatably driving said impeller; and coupling means on said superstructure for enabling a connection of said drive means to said impeller upon a pivoting of said housing from said maintenance orientation to said operational orientation and for alternately enabling a disconnection of said drive means from said impeller prior to a pivoting of said housing from said operational orientation to said maintenance orientation.

2. The pump defined in claim 1 wherein said mounting means includes a pair of pivot bearings attached to said superstructure on opposite sides of said housing.

3. The pump defined in claim 2 wherein said pivot bearings are aligned with one another to define a substantially horizontal pivot axis of said housing relative to said superstructure.

4. The pump defined in claim 3 wherein said housing has a center of gravity with a first height in said operational orientation, said pivot axis having a second height less than said first height.

5. The pump defined in claim 1 wherein said impeller defines a hollow chamber, further comprising a pitot tube disposed in said impeller, said pitot tube having a pump outlet disposed below said impeller in said operational orientation of said housing.

6. The pump defined in claim 1 wherein said mounting means includes a removable tie plate and a disconnectable hollow coupling disposed between said drive means and said housing.

7. The pump defined in claim 1, further comprising detachable locking plates connecting said housing to said superstructure.

8. The pump defined in claim 1 wherein said drive means includes a gear box, a coupling and a motor.

9. The pump defined in claim 1 wherein said longitudinal axis is substantially horizontal in said maintenance orientation.

10. A method for accessing a pump having a housing mounted to a support superstructure and also having an impeller rotatably disposed in said housing, said pump including a motor mounted to said superstructure and operatively connected to said impeller, said pump further including an inlet port and an outlet port connected to an inlet conduit and an outlet conduit, respectively, the method comprising the steps of:

disconnecting the impeller and the housing from the motor;

disconnecting the inlet port from the inlet conduit and the outlet port from the outlet conduit;

upon completion of said steps of disconnecting, pivoting said housing together with said impeller about a substantially horizontal axis to swing said housing from a substantially vertical operational orientation to a maintenance orientation at an angle to the vertical;

maintaining said motor in a fixed location on said superstructure before, during and after said step of pivoting;

performing maintenance operations on components of the pump while said housing is maintained in said maintenance orientation;

upon completion of said step of performing, rotating said housing together with said impeller about said axis to swing said housing from said maintenance orientation to said operational orientation;

upon completion of said step of rotating, reconnecting said impeller and said housing to said motor; and also upon completion of said step of rotating, reconnecting said inlet port to said inlet conduit and said outlet port to said outlet conduit.

11. The method defined in claim 10 wherein said pump includes a tie plate disposed between a motor coupling and said housing, said step of disconnecting the impeller and the housing from the motor including the step of removing said tie plate.

12. The method defined in claim 10 wherein said pump includes locking plates connecting said housing to said superstructure, further comprising the step of removing said locking plates prior to said step of pivoting said housing and said impeller from said operational orientation to said maintenance orientation.

13. The method defined in claim 10 wherein said step of performing includes the steps of removing a seal from said housing and inserting a substitute seal.

14. The method defined in claim 10 wherein said housing includes a manifold located between said impeller and said inlet port, a seal being located between said impeller and said manifold, said step of performing includes the steps of removing said seal from between said impeller and said manifold and inserting a substitute seal.

15. The method defined in claim 10, further comprising the step of supporting said housing at least partially from said superstructure during said steps of pivoting performing and rotating.

* * * * *